US005984452A

United States Patent [19]

Bekki

[11] Patent Number: 5,984,452

[45] Date of Patent: Nov. 16, 1999

[54] INK JET RECORDING APPARATUS, AND A METHOD FOR RECOVERING AN INK JET RECORDING HEAD

[75] Inventor: Toshihiko Bekki, Yokohama, Japan

[73] Assignee: Canon Kabushiki Kaisha, Tokyo, Japan

[21] Appl. No.: 09/025,653

[22] Filed: Feb. 18, 1998

[30] Foreign Application Priority Data

Feb. 19, 1997 [JP] Japan ..... 9-035066
Feb. 5, 1998 [JP] Japan ..... 10-024431

[51] Int. Cl.[6] ..... B41J 2/165

[52] U.S. Cl. ..... 347/33; 347/22

[58] Field of Search ..... 347/33, 31, 32, 347/34, 22

[56] References Cited

U.S. PATENT DOCUMENTS

| | | | |
|---|---|---|---|
| 5,103,244 | 4/1992 | Gast et al. | 347/33 |
| 5,115,250 | 5/1992 | Harmon et al. | 347/33 |
| 5,202,702 | 4/1993 | Terasawa et al. | 346/1.1 |
| 5,384,586 | 1/1995 | Hirano et al. | 346/134 |
| 5,534,894 | 7/1996 | Hirano et al. | 346/134 |
| 5,714,991 | 2/1998 | Osborne et al. | 347/30 |
| 5,798,775 | 8/1998 | Takahashi et al. | 347/22 |
| 5,815,176 | 9/1998 | Rotering | 347/33 |

FOREIGN PATENT DOCUMENTS

| | | |
|---|---|---|
| 0 553 561 | 8/1993 | European Pat. Off. . |
| 0 673 772 | 9/1995 | European Pat. Off. . |
| 0 684 139 | 11/1995 | European Pat. Off. . |
| 0 730 965 | 9/1996 | European Pat. Off. . |

*Primary Examiner*—Edgar Burr
*Assistant Examiner*—Dav A. Ghatt
*Attorney, Agent, or Firm*—Fitzpatrick, Cella, Harper & Scinto

[57] ABSTRACT

An ink jet recording apparatus, which is provided with a blade for wiping the surface of discharge openings of an ink jet recording head, and a blade cleaner for removing ink adhering to the blade, comprises a cleaning device for cleaning the blade by enabling the blade cleaner and the blade to reciprocate correlatively. This cleaning device causes the blade cleaner to be in elastic contact with the blade intensively without rotating the blade cleaner when the blade moves forward, and for causes the blade cleaner to rotate to be in elastic contact with the blade weakly when the blade moves backward. With the structure thus arranged, it is possible to reduce the spraying of ink from the blade into the interior of the ink jet recording apparatus significantly. Therefore, the surface of discharge openings of the ink jet recording head can be cleaned by a blade in good condition to make it possible to operate cleaning in the most suitable mode.

14 Claims, 11 Drawing Sheets

INK JET RECORDING APPARATUS, AND A METHOD FOR RECOVERING AN INK JET RECORDING HEAD

BACKGROUND OF THE INVENTION

1. Field of the Invention

The present invention relates to an ink jet recording apparatus that records on a recording medium by discharging ink, and a method for recovering an ink jet recording head. More particularly, the invention relates to an ink jet recording apparatus provided with means for cleaning the surface of discharge openings of an ink jet recording head, and also, relates to a method for recovering the recording head thereof.

2. Related Background Art

Conventionally, a recording apparatus that records on paper, cloth, plastic sheet, OHP sheet, or the like (hereinafter, may also be referred to simply as a "recording sheet") is generally proposed as a recording apparatus having a mode in which it can mount a recording head of various recording types, such as wire-dot, thermosensitive, thermal transfer, or ink jet.

Of these recording apparatuses, a recording apparatus of the ink jet recording type (hereinafter referred to as an "ink jet recording apparatus") that records on a recording sheet by discharging ink from discharge openings, namely, nozzles, is arranged to adopt non-impact recording method having a lesser amount of noises, and also, it is arranged to perform recording operations in high density at high speeds.

Generally, an ink jet recording apparatus comprises means for driving a carriage mounting a recording head on it; conveying means for conveying a recording sheet; and control means for controlling these driving means and conveying means.

On the other hand, as energy generating devices that generate energy to be utilized for discharging ink from the ink discharge openings of the recording head, there are such devices as piezoelectric or some other electromechanical transducing devices, devices irradiating laser or some other electromagnetic waves to generate heat to be applied when discharging ink droplets, or electrothermal transducing devices having heat generating resistors for heating liquid, among some others.

Of these devices, the recording head of ink jet recording type, which discharges ink droplets by the utilization of thermal energy, is capable of recording in high resolution, because this type of the head enables the ink discharge openings to be arranged in high density. Of the heads of this type, the ink jet recording head that uses electrothermal transducing devices as energy generating devices is particularly effective in making the head smaller not only because it is possible to fully utilize for its manufacture the advantages of the IC technologies and micro-machining technologies and techniques whose advancement and reliability have been enhanced remarkably in the field of semiconductor industry of late, but also, because it is easier to assemble the head in high density at lower costs of manufacture.

As described above, the ink jet recording type is the one that can be made with simpler structures, and demonstrates excellent performance. On the other hand, however, this type has several problems yet to be solved.

At first, one of such problems is the stains that adhere to the surface where ink discharge openings are arranged for the ink jet recording head (hereinafter referred to as the "surface of discharge openings"). The stains are caused mainly by two factors. One of them is brought about by the adhesion of a part of the ink droplets which have been discharged for printing and impacted upon a recording sheet but rebounded to the surface of the discharge openings without adhering to the recording sheet, and also, by the adhesion of the fine ink droplets to the surface of discharge openings, which have been discharged but caused to float in the atmosphere besides the main ink droplets as ink is being discharged for recording. The other factor is brought about by the ink droplets remaining on the surface of discharge openings when the cap is removed from this face after having sucked ink in the ink paths or the like that conductively connect with the discharge openings or ink in the vicinity thereof when the cap is closely covered on the surface of discharge openings for the performance of recovery operation to prevent the clogging of the ink discharge openings.

If unwanted ink droplets adhere to the circumference of the ink discharge openings, there occurs the so-called "twist" that causes the direction of ink discharges to be deviated or the so-called "non-discharge" that causes the ink discharge to be disabled, hence resulting in the degradation of printing quality.

As means for solving the problems described above, there is often used a method for wiping the surface of discharge openings of an ink jet recording head with a blade (that may also be referred to as a "wiper") formed by rubber or some other elastic material (hereinafter referred to as "wiping"). As the wiping method, there are such ones in which the surface of discharge openings are allowed to be in contact with a stationary blade when the recording head is scanned or the blade moves in parallel with or rotates around the stationary recording head to be in contact with the surface of discharge openings. In order to allow the recording head to scan, the main scanning operation is most often utilized for recording. In other words, this scanning makes it possible to perform the wiping only when it is needed if only the blade is arranged to be able to advance to or retract from the position that is overlapped with the scanning position of the recording head. Also, in order to allow the blade to scan, it should be arranged to enable the blade to reciprocate in the direction orthogonal to the main scanning direction by means of the parallel advance or rotation of the blade. In this case, the ink jet recording head is arranged to be able to advance to or retract from the scanning position of the blade, hence making the wiping possible only when it is needed. In other words, if the wiping should be made only in the forward operation, the ink jet recording head is retracted in its returning operation. In this manner, it becomes possible to prevent the contact between the blade and ink jet recording head from being made more than necessary.

Further, in order to maintain the performance of the blade operation, it is most desirable to remove ink that adheres to the blade particularly when the blade is formed by rubber or the like. Therefore, it is practiced to allow the blade to abut upon an absorbent to absorb ink or to abut upon a molded or metallic edge to scape off ink from the blade. When the wiping is performed by means of the main scanning of the ink jet recording head, a cleaning member is installed on the ink jet recording head or on a carriage that mounts the ink jet recording head on it so as to clean the blade. Also, when the wiping is performed by means of the scanning of the blade, a cleaning member is installed on a location where the blade is in contact with it immediately after the blade has wiped off the ink jet recording head.

However, as the blade passes the blade cleaner correlatively, there is a fear that the blade is caused to bend once, and then, ink remaining by adhering on the blade sprays upon the restoring operation of the blade, thus staining the interior of the ink jet recording apparatus.

SUMMARY OF THE INVENTION

The present invention is designed with a view to solving the problems described above. It is an object of the invention to provide an ink jet recording apparatus capable of preventing ink from spreading into the interior of the ink jet recording apparatus when blade cleaning is executed, as well as to provide a method for recovering a recording head as well.

It is another object of the invention to provide an ink jet recording apparatus having a blade for wiping off the surface of discharging openings of the ink jet recording head, as well as a blade cleaner for removing ink adhering to the blade, comprising cleaning means for cleaning the blade by arranging the blade cleaner and the blade to reciprocate correlatively, the cleaning means being provided with supporting means for enabling the blade to be in contact intensively with the blade cleaner elastically without rotating the blade cleaner when this means advances, and enabling the blade cleaner to rotate so as to be in contact slightly with the blade elastically when this means retracts.

In accordance with the present invention, it is structured to arrange a one-way mechanism for the blade that wipes off the surface of discharge openings of an ink jet recording head, as well as the blade cleaner for wiping off ink adhering to the blade. Here, the blade cleaner abuts upon a stopper to fix it for performing the cleaning operation appropriately when the blade that has wiped off the surface of discharge openings once is allowed to be in contact with the blade cleaner, and then, when the blade returns to the original position, the blade cleaner rotates to be away from the blade so that the blade is not bent. In this manner, it is possible to reduce the spreading of ink into the interior of the ink jet recording apparatus significantly. Therefore, the surface of discharge openings of the ink jet recording head can be cleaned by means of a blade in good condition, hence making it possible to operate cleaning in the most suitable mode.

In this respect, if the portion of the blade cleaner to be in contact with the blade is formed by a member for absorbing ink, ink can be absorbed suitably.

If the blade cleaner and blade are inclined to the direction of the correlative reciprocation thereof, it is possible to significantly reduce the ink spreading from the blade into the interior of the apparatus.

If the blade cleaner is inclined to the direction of the movement of the blade, it is possible to process the blade cleaner easily.

If the portion of the blade cleaner to contact with the blade is an edge formed by molding, the edge can be formed easily by means of molding or some other formation process.

If the portion of the blade cleaner to contact with the blade is an edge formed by metal, it is possible to produce the edge by metallic material or the like simply and easily.

If a portion lower than the edge is arranged for both ends of the edge, it becomes possible to protect the edge suitably.

If the bend of a closely coiled spring in the diameter direction thereof is used for biasing the blade cleaner, it is possible to press the blade cleaner by the application of an appropriate force for a good operation.

If a tensioning coil spring is used for biasing the blade cleaner, the blade cleaner can operate in good condition.

If a twisted coil spring is used for biasing the blade cleaner, the blade cleaner can operate in good condition If walls are arranged for the blade cleaner on the side opposite to the ink jet recording head, it becomes possible to prevent ink from being spread and dispersed suitably.

In accordance with the present invention, a method for recovering an ink jet recording head comprises the steps of wiping the surface of discharge openings of an ink jet recording head by use of a blade; of cleaning the blade by enabling the blade to contact and pass a blade cleaner; and of rotating the blade cleaner to escape when the blade returns to the original position before the wiping step through the same path in the blade cleaning step. Therefore, when the blade, which has wiped the surface of discharge openings of the ink jet recording head, abuts upon the blade cleaner, the blade cleaner abuts upon a stopper, and it is fixed for performing the operation of blade cleaning suitably. When the blade should return to the original position, the blade cleaner rotates to escape from the blade so that the blade is not bent at all. Therefore, the spreading of ink from the blade into the interior of the apparatus can be reduced significantly. In this manner, the surface of discharge openings of the ink jet recording head can be wiped off by means of the blade in good condition.

BRIEF DESCRIPTION OF THE DRAWINGS

FIG. 8A shows when the blade cleaner is in operation, and FIG. 8B is a partial view which shows when the blade clear returns to its non-operative position.

FIG. 12A shows the moment the leading end of the blade is about to part from the cleaner; FIG. 12B shows the state immediately after it has parted from the cleaner.

FIG. 13A is a perspective view showing the cleaning portion substantially at right angles to the direction in which the blade moves; FIG. 13B is a perspective view showing the cleaning portion inclined to the direction in which the blade moves.

DETAILED DESCRIPTION OF THE PREFERRED EMBODIMENTS

First Embodiment

Figure 1:
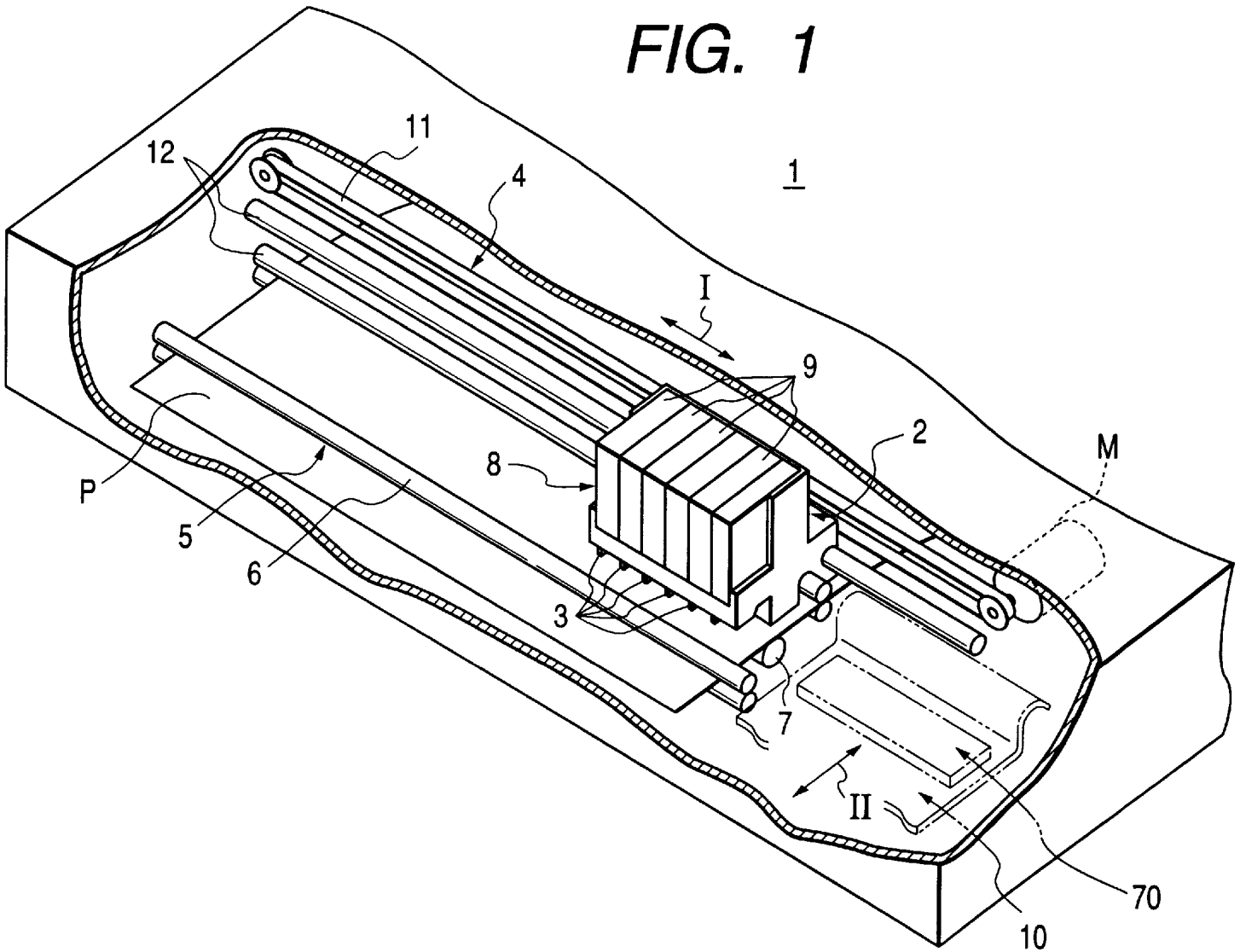
FIG. 1 is a perspective view which schematically shows an ink jet recording apparatus of the present invention with a partially broken representation of the casing thereof.

FIG. 1 is a perspective view which schematically shows an ink jet recording apparatus in accordance with a first embodiment of the present invention. This view schematically illustrates the structure of the ink jet recording apparatus provided with a cleaning device around the blade of an ink jet recording head, and a recovery device as well.

In accordance with the first embodiment of the present invention, the ink jet recording apparatus 1 comprises, as shown in FIG. 1, a driving motor M serving as driving source; a carriage 2 that mounts an ink jet recording head 3 on it; a carrier mechanism 4 that enables the carriage 2 to reciprocate by means of the driving motor M; a sheet feeding mechanism 5 that conveys a recording sheet P serving as a recording medium; a recovery device 70 that performs discharge recovery process (capping, suction recovery, and the like) for maintaining the discharge performance of the ink jet recording head 3; and a cleaning device 10 that cleans the surface of discharge openings 13 of the ink jet recording head 3. Also, a power transmission mechanism is appropriately structured so as to enable the carrier mechanism 4, the sheet feeding mechanism 5, and other operational mechanisms to be driven by the utilization of the driving motor M.

For the ink jet recording apparatus 1 shown in FIG. 1, the recording sheet P is carried by means of the feeding roller 6 of the sheet feeding mechanism 5. Then, on a platen 7, given recording is made on the recording sheet P by means of the ink jet recording head 3.

Also, an ink jet cartridge 8 mounted on the carriage 2 is arranged, for example, by the ink jet recording head 3 integrally provided with an ink tank that retains ink to be supplied to the ink jet recording head 3. The ink jet cartridge is detachably mounted on the carriage 2 that serves as a member to install the ink jet recording head on it. In this case, the arrangement is made so that the contact surface between the carriage 2 and ink jet recording head 3 is in good condition to effectuate and maintain the required electrical connection between them.

Figure 14:
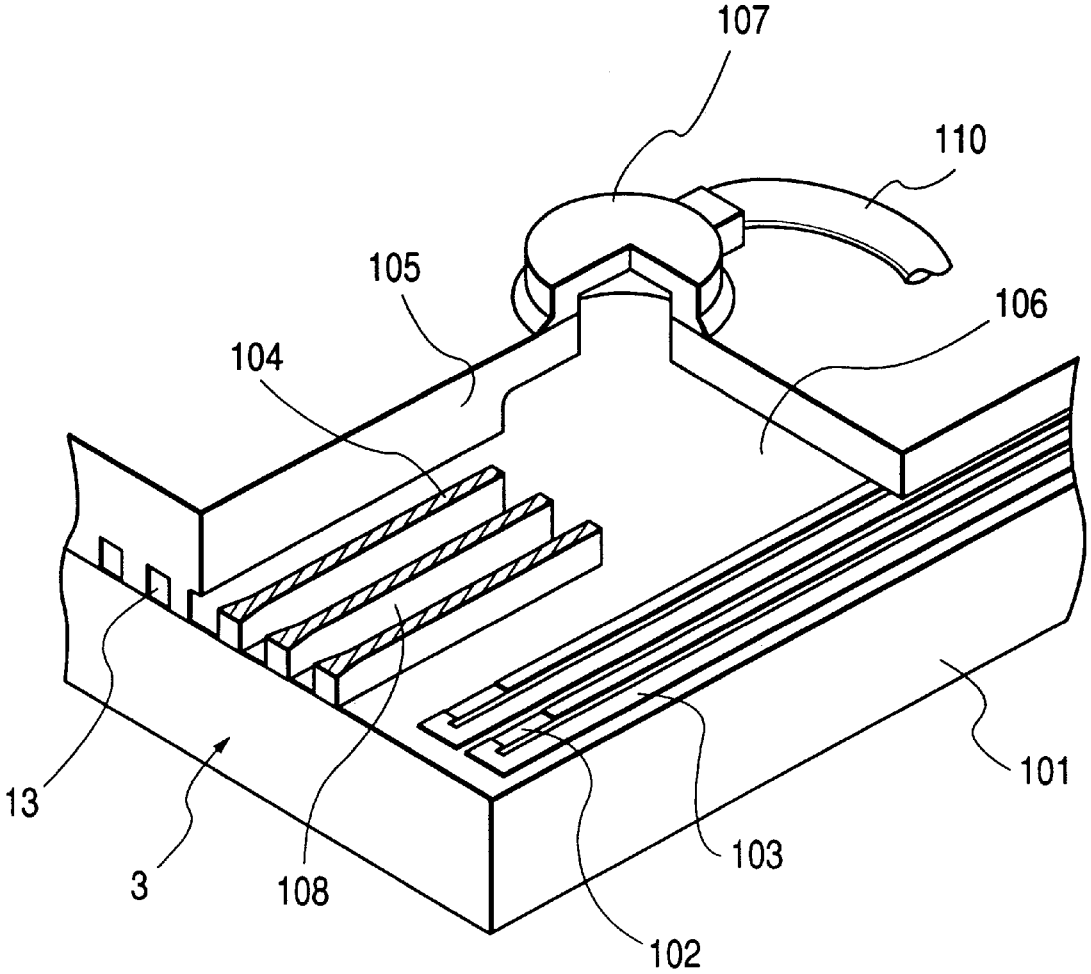
FIG. 14 is a partially broken perspective view which shows one example of an ink jet recording head.

The ink jet recording head 3 comprises, as shown in FIG. 14, for example, electrothermal transducing elements (electrothermal transducing devices) 102, electrodes 103, nozzle walls 104, and a ceiling plate 105, which are produced by film formation on the substrate 101 through the semi-conductor manufacturing processes, such as etching, deposition, sputtering.

Recording ink is supplied from the ink tank 9 (see FIG. 1) to a common liquid chamber 106 through an ink supply tube 110. In FIG. 14, a reference numeral 107 designates a connector for use of the supply tube. Ink supplied to the common liquid chamber 106 is supplied to the liquid paths 108 that constitute nozzles by means of capillary phenomenon, which is stably held on the surface of discharge openings 13 when it forms meniscus at each leading end of nozzles of the recording head 3.

In this respect, when the electrothermal transducing devices 102 are energized through the electrodes 103, ink on each surface of the electrothermal transducing devices is heated to create foaming phenomenon brought about by film boiling in ink. By the foaming energy thus generated, ink droplets are discharged from the surface of discharge openings 13.

With the structure described above, it becomes possible to manufacture an ink jet recording head 3 having a multiple nozzle arrangement, such as 128 nozzles or 256 nozzles in a nozzle density of as high as 16 nozzles per mm.

A plurality of recording heads may be arranged in accordance with a number corresponding to ink having different colors and densities (hereinafter referred to as "color tone") or the head may be made integrally as one body for use of a plurality of color tones or it may be arranged to provide different discharge units for different color tones, respectively.

Now, returning to FIG. 1, the carriage 2 is connected with a part of the driving belt 11 of the carrier mechanism 4 that transmits the driving power of the driving motor M. The carriage is mounted on the two parallel guide shafts 12 so that the carriage is made slidable along the guide shafts in the scanning direction, and arranged to be driven by means of the driving motor M. Therefore, the carriage 2 reciprocates along the guide shafts 12 by the regular and reverse driving of the driving motor M. Also, the driving motor M drives the feeding roller 6 of the sheet feeding mechanism 5 through an appropriate transmission mechanism. With the structure thus arranged, the recording sheet P is being carried.

In other words, as shown in FIG. 1, the ink jet recording apparatus 1 is provided with the platen 7 confronted with the surface of discharge openings of the ink jet recording head 3. Here, while the carriage 2, which mounts the ink jet recording head 3 on it, is driven to reciprocate by the driving force of the driving motor M in the directions indicated by arrows in FIG. 1, recording signals are being transmitted to the ink jet recording head 3. The structure is also arranged so that in accordance with such signals, ink is discharged to the entire recordable width of the recording sheet P serving as the recording medium which has been carried onto the platen 7, thus making it possible to execute recording in good condition.

Also, for an ink jet recording apparatus 1 of the kind, it is possible to provide an appropriate recovery device 70 for use of the ink jet recording head 3 outside the range of the reciprocation of the carriage 2 that mounts the ink jet recording head 3 for the execution of recording. The location outside such range of reciprocation may be a position opposite to the home position of the recording head, for example. Here, the recovery device 70 for use of the ink jet recording head 3 has the structure which is generally in use. The recovery device is arranged to be able to change its position arbitrarily with respect to the cleaning device 10 as shown in FIG. 1. There is also provided a cap member or the like having an ink absorbent for the recovery device to cap the surface of discharge openings 13 of the ink jet recording head 3.

Figure 2:
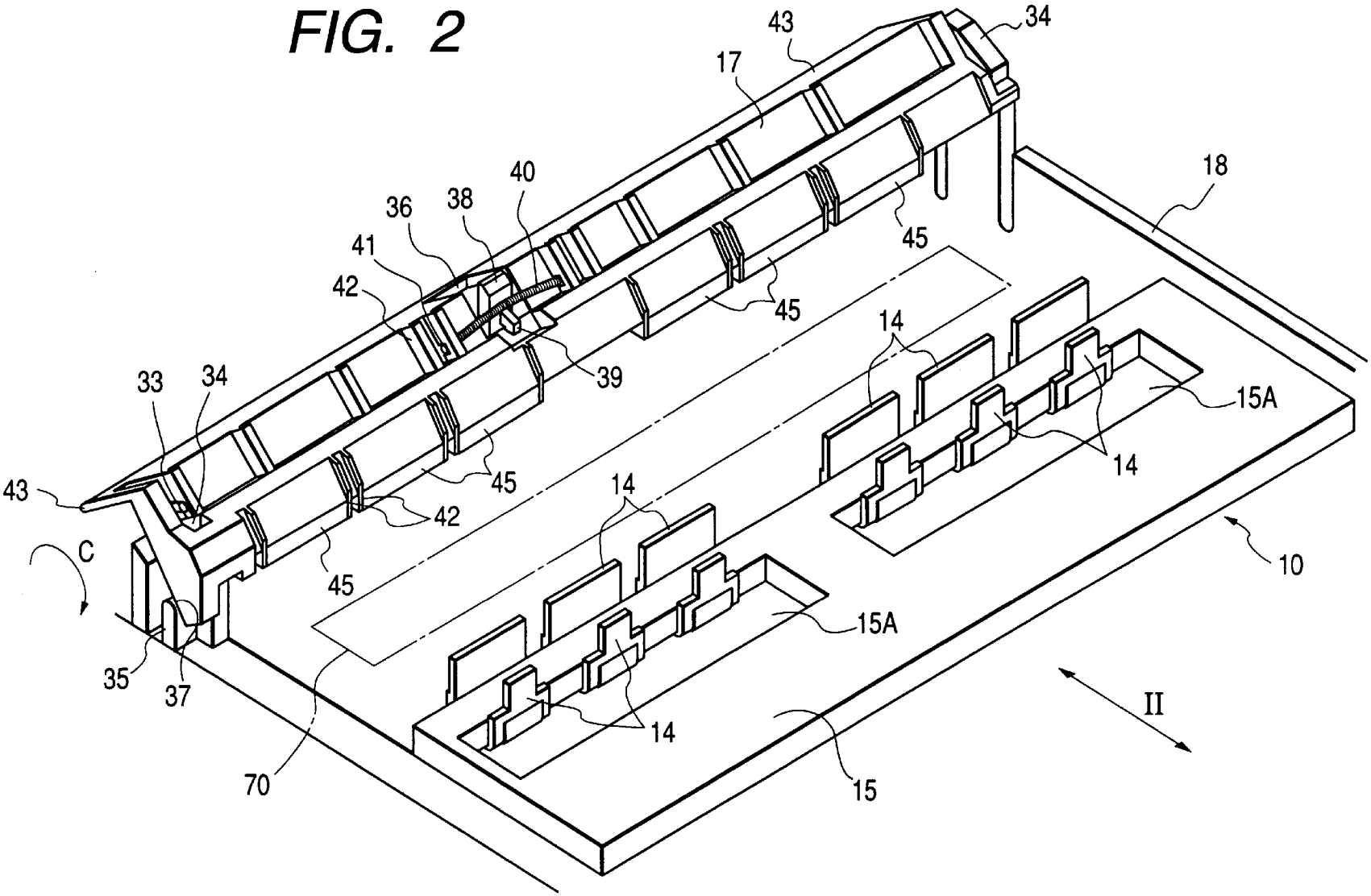
FIG. 2 is a perspective view which shows the blade cleaning device of the ink jet recording apparatus of the present invention represented in FIG. 1.
Figure 3:
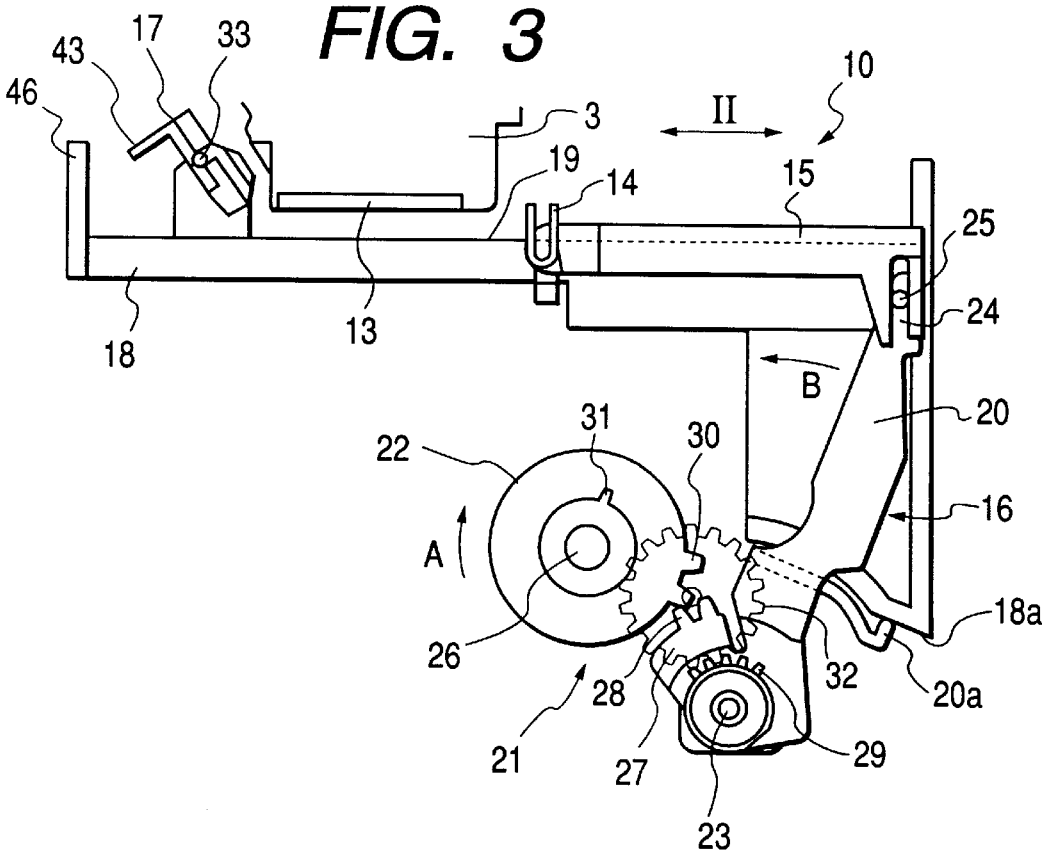
FIG. 3 is a side view which shows the state of the operation of the blade cleaning device of the present invention before it begins its cleaning operation.

The cap member is arranged to cap the surface of discharge openings 13 of the ink jet recording head 3 at an appropriate timing when the head is in its home position to be in standby for a recording operation, before and after a recording operation, or during a recording operation. Then, while the surface of discharge openings 13 of the ink jet recording head 3 is capped by the cap member, ink is sucked by a pump or appropriate suction means provided for the recovery device 70 or ink is compressed by appropriate pressure means provided for ink supply paths of the ink jet recording head 3, thus exhausting ink compulsorily from the discharge openings. In this manner, the discharge recovery is processed to remove overly viscous ink or the like from the ink flow paths of the ink jet recording head 3. Also, at the termination of recording or the like, it is of course possible to recover and protect the ink jet recording head 3 by capping the surface of discharge openings 13 thereof by use of the cap member. In this respect, an appropriate ink absorbent can be arranged in the interior of the cap member as described above. For such ink absorbent, it may be possible to use "rubycell" (manufactured by Toyo Polymer Co., Ltd.), for example. FIG. 2 is a perspective view which schematically shows the structure of the cleaning device 10 around the blade of the ink jet recording head. FIG. 3 is a side view which shows the structure of the cleaning device 10 and the driving unit thereof. The cleaning device 10 for use of the ink jet recording head 3 of the present embodiment is arranged in a position opposite to the home position where the recovery device 70 is installed as also described above, for example. The cleaning device can be positioned appropriately in place of the recovery device 70 to face the recording head 3. In accordance with the present embodiment, a cleaning device 10 of the kind briefly comprises, as shown in FIG. 3, a blade 14 serving as a wiping member that wipes and cleans the surface of discharge opening 13 of the ink jet recording head 3; a blade holder 15 movable along the guiding unit 19, while supporting the blade 14; and an operational mechanism 16 that enables the blade holder 15 to reciprocate. The blade 14 that cleans the surface of discharge openings 13 of the ink jet recording head 3 is formed of an appropriate elastic material, and held on one end of the blade holder 15 in a mode as shown in FIG. 3. This blade is operated by means of an appropriate driving motor and transmission mechanism as in the recovery device for use of the ink jet recording head 3 as described earlier. In this manner, the blade is pressed to the surface of discharge openings 13 of the ink jet recording head 3 to wipe and clean this surface 13.

Therefore, after recording performed by the ink jet recording head 3 of the ink jet recording apparatus 1, the ink jet recording head 3 is positioned in the home position. Then, it becomes possible to clean the adhesion of ink or the like, dew condensation, wetting, or dust particles residing on the surface of discharge openings 13 of the ink jet recording head 3 during the wiping process executed by the movement of the cleaning device 10.

The carriage 2 that mounts the ink jet recording head 3 on it has its main scanning directions as indicated by arrows I in FIG. 1, and reciprocates accordingly. In order to clean the surface of discharge openings 13 of the ink jet recording head 3 mounted on the carriage 2, the cleaning device 10 is arranged in the home position of the carriage 2 that reciprocates along the guide shaft 12 of the ink jet recording apparatus 1 shown in FIG. 1. In other words, the cleaning device is arranged in the home position of the ink jet recording head 3.

The cleaning device 10 of the ink jet recording apparatus of the present invention comprises, as shown in FIG. 3, the blade 14; the blade holder 15 that supports one end of the blade 14, while reciprocating to the front and rear in the directions indicted by arrows II along the guide portion 19 on the base 18; the operational mechanism 16 that enables the blade holder 15 to reciprocate; and a rotative blade cleaner 17 that cleans the blade 14.

The blade 14 of the cleaning device 10 of the ink jet recording apparatus 1 of the present invention is installed on the blade holder 15. Then, the blade holder 15 is guided along the guiding portion 19 of the base 18 that supports various parts, and moves in parallel in the left and right directions (indicated by arrows II) in FIG. 3. In other words, the blade holder is thus guided to reciprocate.

In accordance with the present embodiment, the blade 14 that wipes the surface of discharge openings 13 is installed on the blade holder 15. Then, this blade holder 15 is guided to reciprocate in the left and right directions in FIG. 3 along the guiding portion 19 arranged for the base 18 that supports each part. As exemplified in FIG. 3, the cross-section of the blade 14 is almost in a U-letter shape. This blade is arranged to wipe and clean the surface of discharge openings 13 of the ink jet recording head 3 by use of the two blades each almost in a flat rectangular form. Here, it may be possible to arrange only one blade or three blades or more depending on the configuration, and performance of the recording head 3, among some others. Also, some other modes may be adopted for the blade, besides the one whose section is in the U-letter form. It is of course possible to adopt the arrangement so that a plurality of blades are provided in parallel at appropriate pitches, for example. Also, the blade can be produced using rubber or elastomer, such as synthetic rubber or silicone rubber, or an appropriate plastic material having a required elasticity.

As shown in FIG. 3, the blade holder 15 is provided with a number of blades 14 (six blades for the example shown in FIG. 3) corresponding to the number of recording heads 3 mounted on the carriage (or the number of given discharge opening groups arranged per ink color or density). The blade holder reciprocates by means of the operational mechanism 16 in the directions indicated by arrows II along the guiding portion of the base 18.

The operational mechanism 16 that enables the blade holder 15 to reciprocate comprises a blade arm 20 connected with the blade holder 15 at one end, which is rotatively supported on the base 18 by means of the central shaft 23, and a gear mechanism 21 that transmits the driving force from the driving gear 22 driven by an appropriate driving motor (not shown) to the blade arm 20. Also, the connection between the blade holder and the blade arm 20 is made by means of the pin 25 that engages with the elongated groove 24 arranged for the leading end of the blade arm 20.

The gear mechanism 21 that transmits the driving force of the driving motor to the blade arm 20 comprises a driving gear 22 installed on the motor shaft 26, and a driven gear 27 that drives the blade arm 20. The driven gear 27 is integrally installed on the central shaft 23 that supports the blade arm 20. This gear is formed by a gear member 28 for use of forward movement of the blade holder 15 and by a gear member 29 for use of backward movement of the blade holder 15. With respect to these gear members 28 and 29 of the driven gear 27, the driving gear 22 driven by the driving force of the driving motor is integrally formed with a gear member 30 that engages with the gear member 28 for use of the forward movement, and a gear member 31 that engages with the gear member 29 for use of the backward movement through an idle gear 32.

Further, the gear members 28 and 29 on the blade arm 20 side and the gear members 30 and 31 on the driving gear 22 side are provided with gear teeth, respectively, only in the positions required for transmitting the driving force to the blade arm 20 as needed. With the structure thus arranged, the driving gear 22 rotates only one-way to enable the blade arm 20 to move rotatively in reciprocation. Hence, the blade 14 and the blade holder 15 reciprocate in parallel through the combination of the elongated groove 24 and the pin 25.

Also, the blade cleaner 17, which is provided with the cleaning unit 45 that contacts the blade 14 to wipe and clean ink adhering to the blade 14, is rotatively supported on the base 18. The blade cleaner 17 has a section which is almost angled, and is made in a size almost the same as the width of the blade holder 15. On each end of the blade cleaner, a shaft 33 is arranged, respectively. Each of the shafts 33 is fitted into the respective bearings 34 of the base 18 to support the blade cleaner 17 rotatively. In this respect, each blade 14 is provided with six cleaning units 45 each allowing the blade 14 to abut upon the blade cleaner 17 to wipe ink adhering to the blade 14. Such blade 14 is arranged in six locations. The cleaning unit 45 is arranged on the surface parallel with or inclined diagonally to the blade as described later. In other words, this unit is arranged on the surface orthogonal to the direction indicated by arrows II, namely, the direction in which the blade moves or on the surface inclined to the left or the right from this orthogonal surface (the surface in parallel to the blade).

In order to restrict the rotation of the blade cleaner 17 so that the blade cleaner 17 can rotate only in one-way, a stopper 35 is provided for the base 18. This stopper 35 abuts upon the abutting portion 37 of the blade cleaner 17 to stop the movement of the blade cleaner 17 so that it cannot rotate further in the direction indicated by an arrow C in FIG. 2. Also, a cut off portion 36 is arranged on the central part of the blade cleaner 17, and a supporting pole 38 extends from the base 18 into this cut off portion 36. The supporting pole 38 supports the central part of the thin and long blade cleaner 17 by contacting it from the vicinity of the rotational center of the blade cleaner 17, that is, the pole is in contact with such center to be supported from above the vicinity of the axial center of the shaft 33. In this way, blade 14 is allowed to receive the force that pushes up the blade cleaner 17. In this case, the contact portion 39 of the supporting pole 38 is configured to be thinner at the leading end thereof like a rib so that the rotational load may be made smaller for it.

Figure 8A:
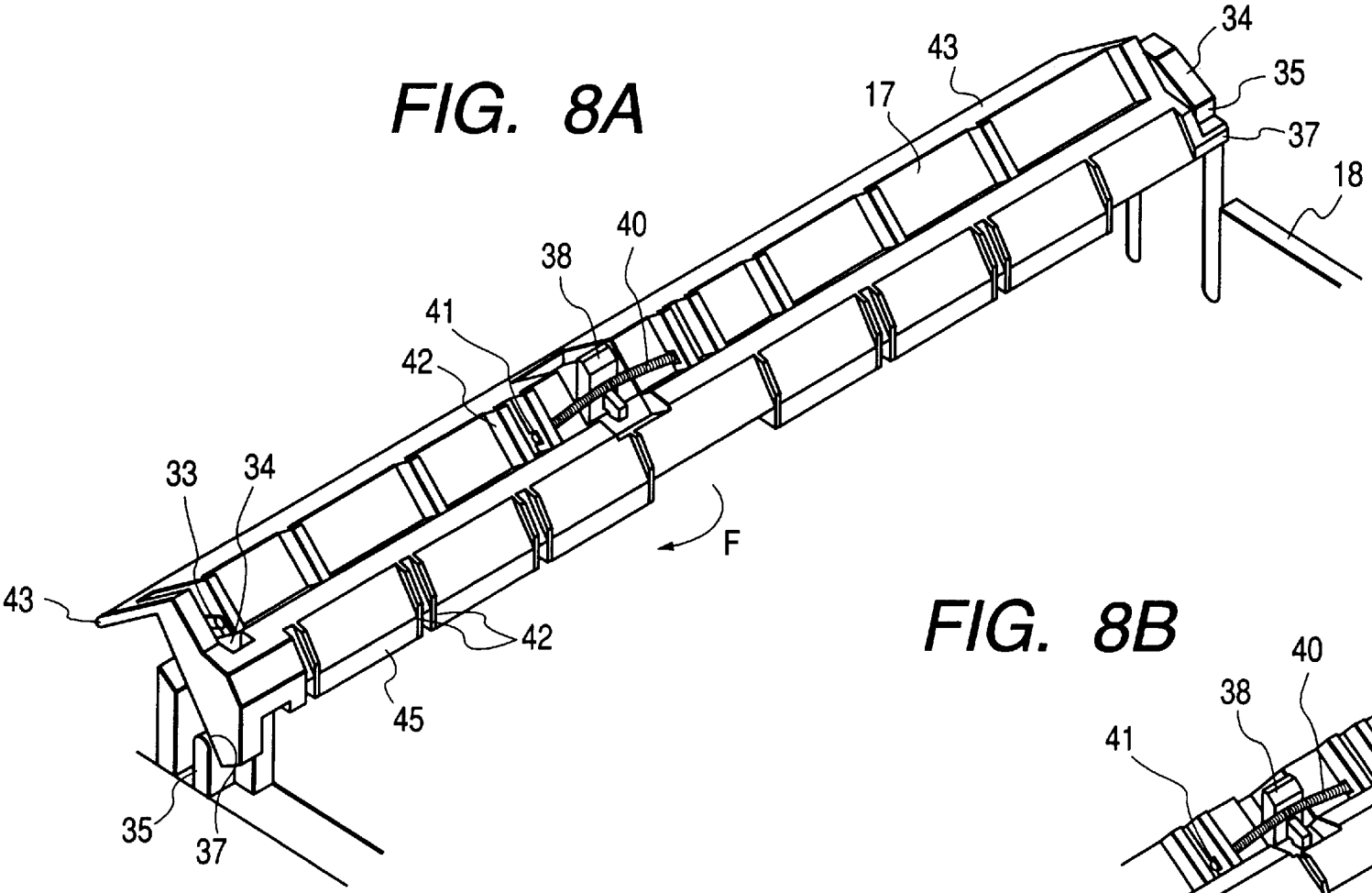
FIGS. 8A and 8B are perspective views which illustrate the blade cleaner of the blade cleaning device of the present invention.
Figure 8B:
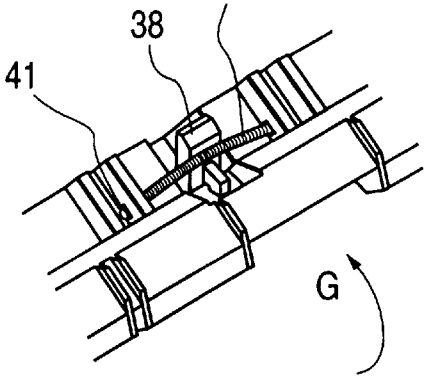

A spring 40 is arranged as shown in FIG. 2 to bias the blade cleaner 17 to abut upon the stopper 35. This spring 40 is formed of a closely coiled spring, but the hooking portions usually provided for both ends of a closely coiled spring generally used are removed for this one. A spring of the kind 40 is installed on the upper side of the supporting pole 38 in the cut off portion 36 on the central part of the blade cleaner 17. The both ends thereof are inserted into the installation sections 41 arranged on the walls 42 of the blade cleaner 17. The spring 40 does not move more than the given looseness in the axial direction and the diameter direction as well. However, its rotation is not regulated. It is possible slightly. Also, since the spring 40 is installed in a position above the rotational center of the blade cleaner 17, the convex shape of the spring 40 is made higher when the supporting pole 38 and the spring installation portions 41 of the blade cleaner 17 become further apart from each other by the rotation of the blade cleaner 17 in the direction indicated by arrow G as shown in FIG. 8B. In this way, the amount of deformation of the spring 40 increases. Then, the reaction of the spring 40 is increased accordingly. By this reaction, the blade cleaner 17 is biased. Also, the blade cleaner 17 whose section is substantially angled is provided with the eaves type screen portion 43 in order to prevent ink from spraying upward. With the provision thereof, the spreading of ink is prevented appropriately.

Figure 9:
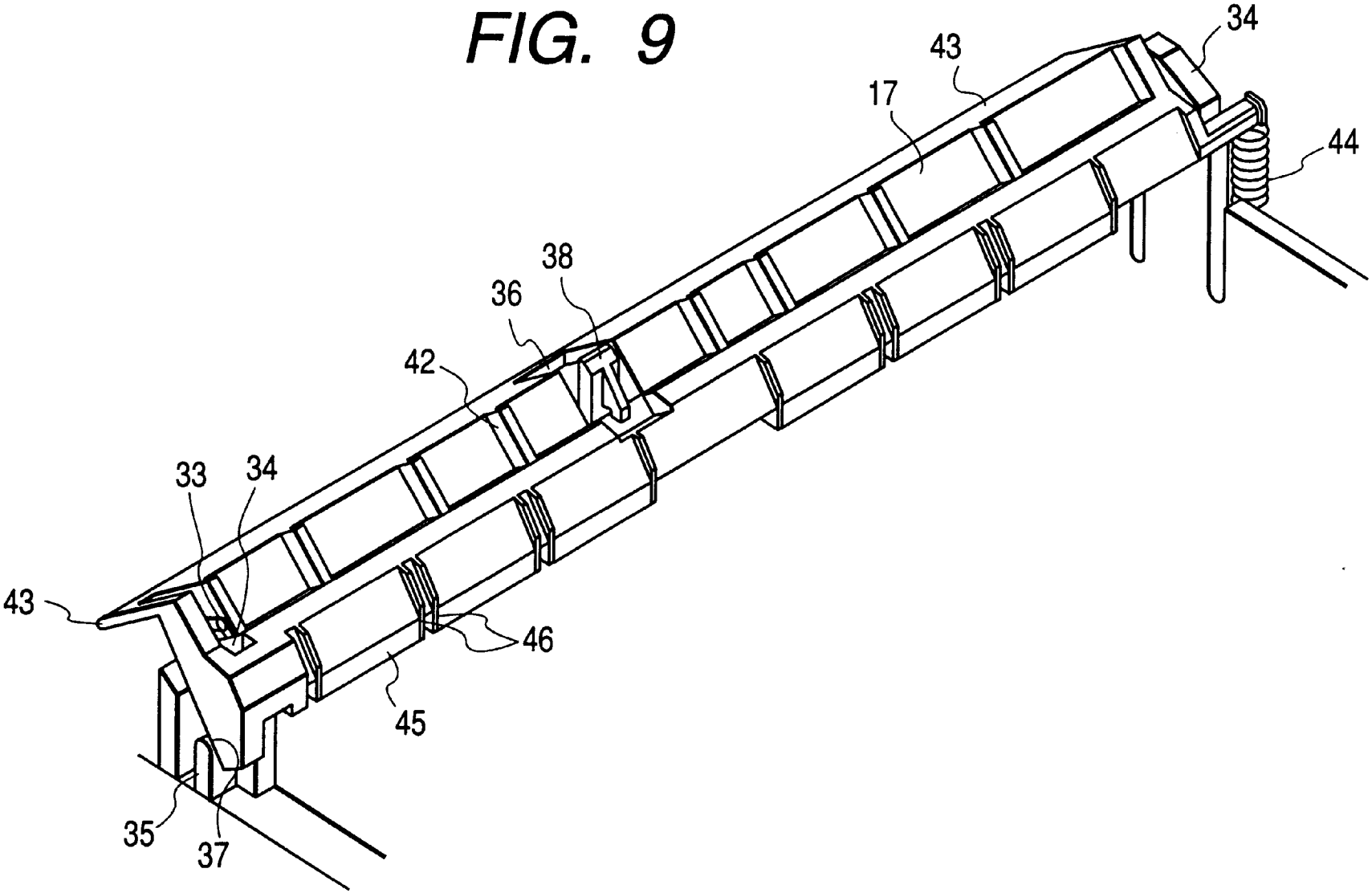
FIG. 9 is a perspective view which schematically shows another example of the blade cleaner of the blade cleaning device of the present invention in the same manner as shown in FIG. 2.

Further, the spring 40 may be formed of a tensioning coil spring 44 provided for one or both ends of the blade cleaner 17 as shown in FIG. 9. Here, the spring 40 is not necessarily limited to the coil spring shown in FIG. 9 as one variation, but any other types may be adoptable. For example, a flat spring or a snapping spring may be suitably usable, among some others.

Now, again, returning to FIG. 3, the description will be continued. The upper end of the blade 14 of the cleaning device 10 is made higher by a given amount (approximately 0.1 mm to 2 mm) than the surface of discharge opening 13 of the ink jet recording apparatus 3 and the bottom surface of the blade cleaner 17. Also, in order to make the blade cleaner 17 lightly rotative, it is more preferable to provide a slightly larger looseness (approximately 0.05 mm to 0.5 mm) for the bearing portion thereof.

Figure 4:
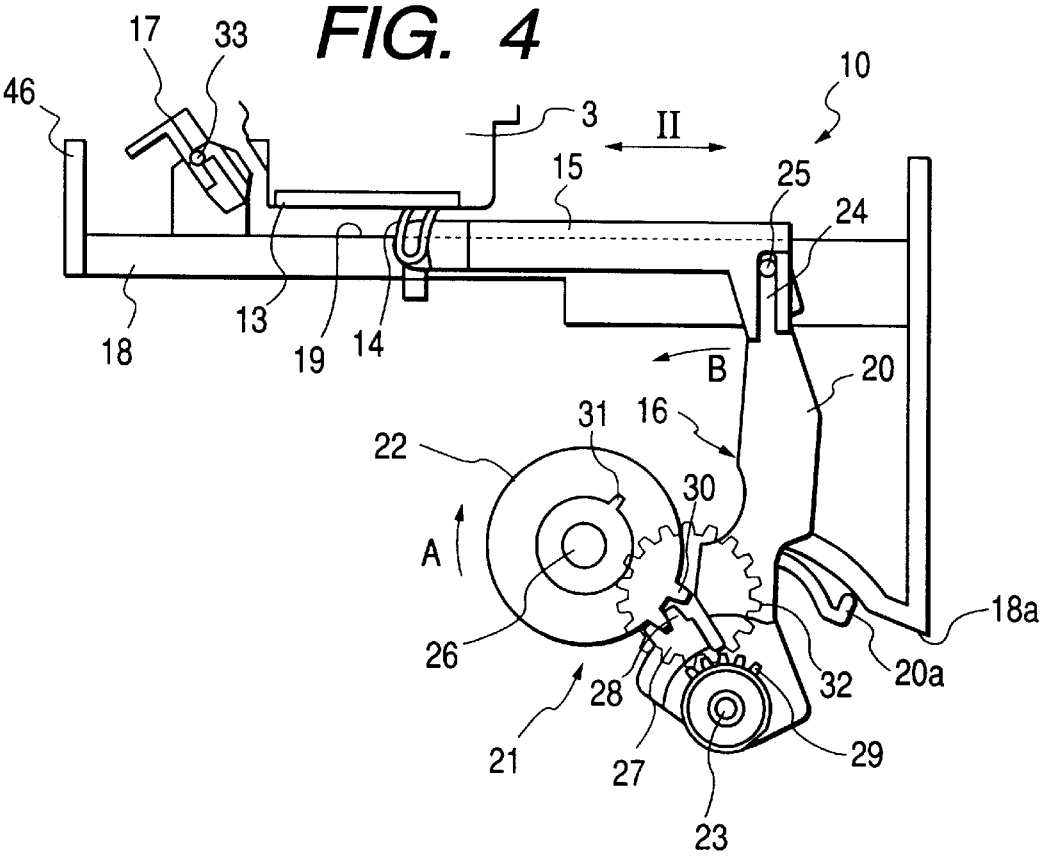
FIG. 4 is a side view which shows the state of the same operation of the blade cleaning operation as represented in FIG. 3, but it illustrates the state when the operation begins.

Now, in conjunction with FIG. 3 to FIG. 7, the description will be made of the cleaning device 10 structured as described above for the ink jet recording apparatus 1 of the present invention, particularly with regard to the operation of the blade and its related parts as well. At first, for the execution of cleaning to make the blade 14 clean, ink and stains adhering to the surface of discharge openings 13 are wiped off and cleaned as shown in FIG. 4 when the blade 14 moves in the state shown in FIG. 3 in the left direction as illustrated in FIG. 4. In other words, when the blade holder 15 moves forward in the direction indicated by arrow B along the guiding portion 19 of the base 18, the leading end of the blade 14 wipes the surface of discharge openings 13 of the ink jet recording head 3. In this way, cleaning is executed to remove ink, stains, and other particles adhering to the surface of discharge openings 13 reliably.

Now, the movement of the blade 14 is made by driving the driving gear 22 by use of a driving motor (not shown). Here, the gear member 30 of the driving gear 22 drives the gear member 28 of the blade arm 20. The driving gear 22 is provided with the gear member 28 for use of the forward movement and the gear member 29 for use of the backward movement on the motor shaft 26 as described earlier. Therefore, when the driving gear 22 rotates from the state shown in FIG. 3 in the direction indicated by arrow A, the gear member 30 and gear member 28 are caused to engage with each other to enable the blade arm 20 to rotate in the direction indicated by arrow B. Thus, the blade 14 moves in the left direction in FIG. 4. In the state shown in FIG. 4, the blade 14 begins wiping the surface of discharge openings 13 of the recording head 3.

Figure 5:
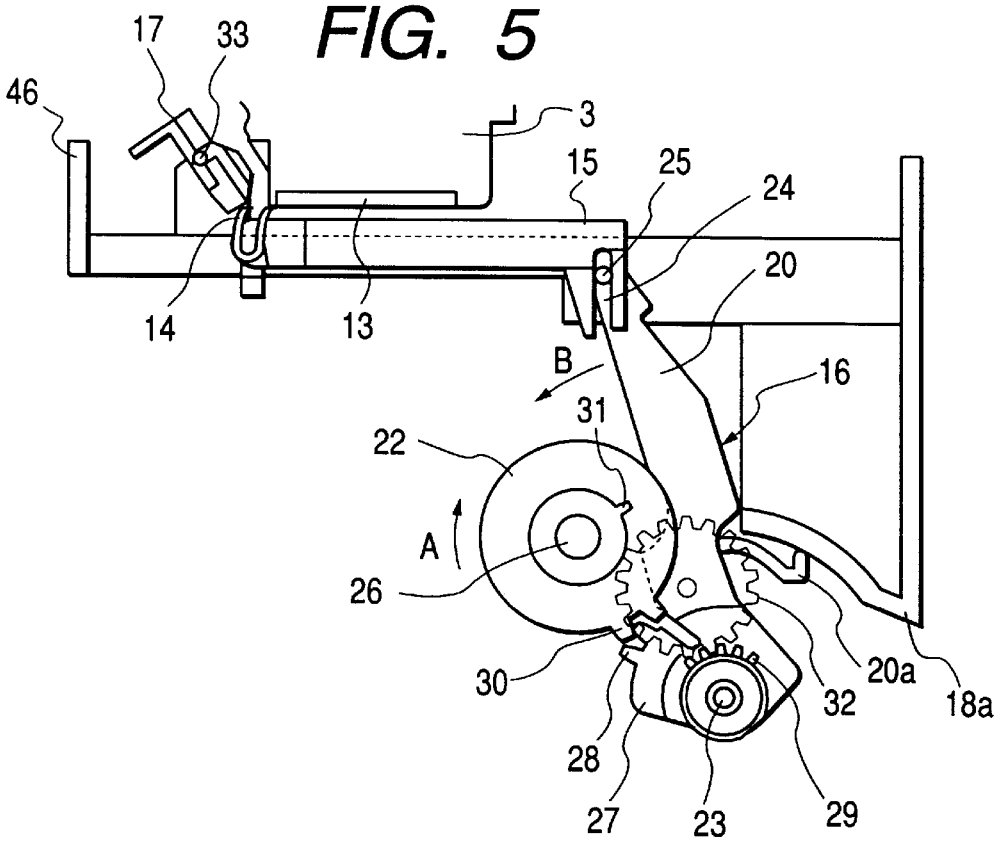
FIG. 5 is a side view which shows the state of the same operation of the blade cleaning operation as represented in FIG. 3, but it illustrates the state when the operation terminates.

Then, the driving gear 22 further rotates, the blade 14 wipes the entire surface of discharge openings 13 and passes it as shown in FIG. 5, thus abutting upon the cleaning portion 45 of the blade cleaner 17. As a result, the abutting portion 37 of the blade cleaner 17 abuts upon the stopper 35. The blade cleaner does not rotate any longer. Then, the blade 14 slips under the cleaning portion 45 while being bent as shown in FIG. 5. At this juncture, ink adhering to the leading end of the blade 14 is wiped off by the cleaning portion 45 of the blade cleaner 17. In this case, cleaning is given only to the leading end of the blade 14. Therefore, there is still a considerable amount of ink adhering to the blade as a whole. However, in order to wipe off the surface of discharge openings 13 of the ink jet recording head 3, it should be good enough if only the leading end of the blade 14 is clean. For that matter, the arrangement described above should be sufficient enough for the blade 14 for its functional operation.

Figure 6:
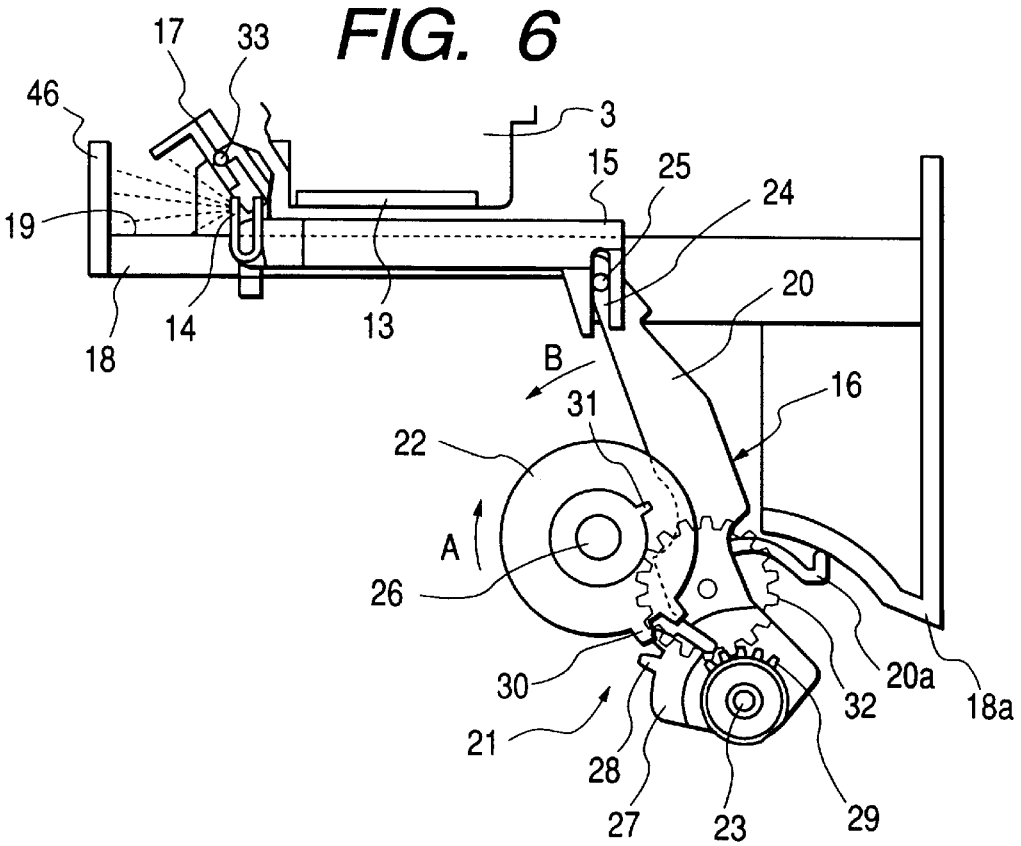
FIG. 6 is a side view which shows the state of the same operation of the blade cleaning operation as represented in FIG. 3, but it illustrates the state after the operation terminates.
Figure 7:
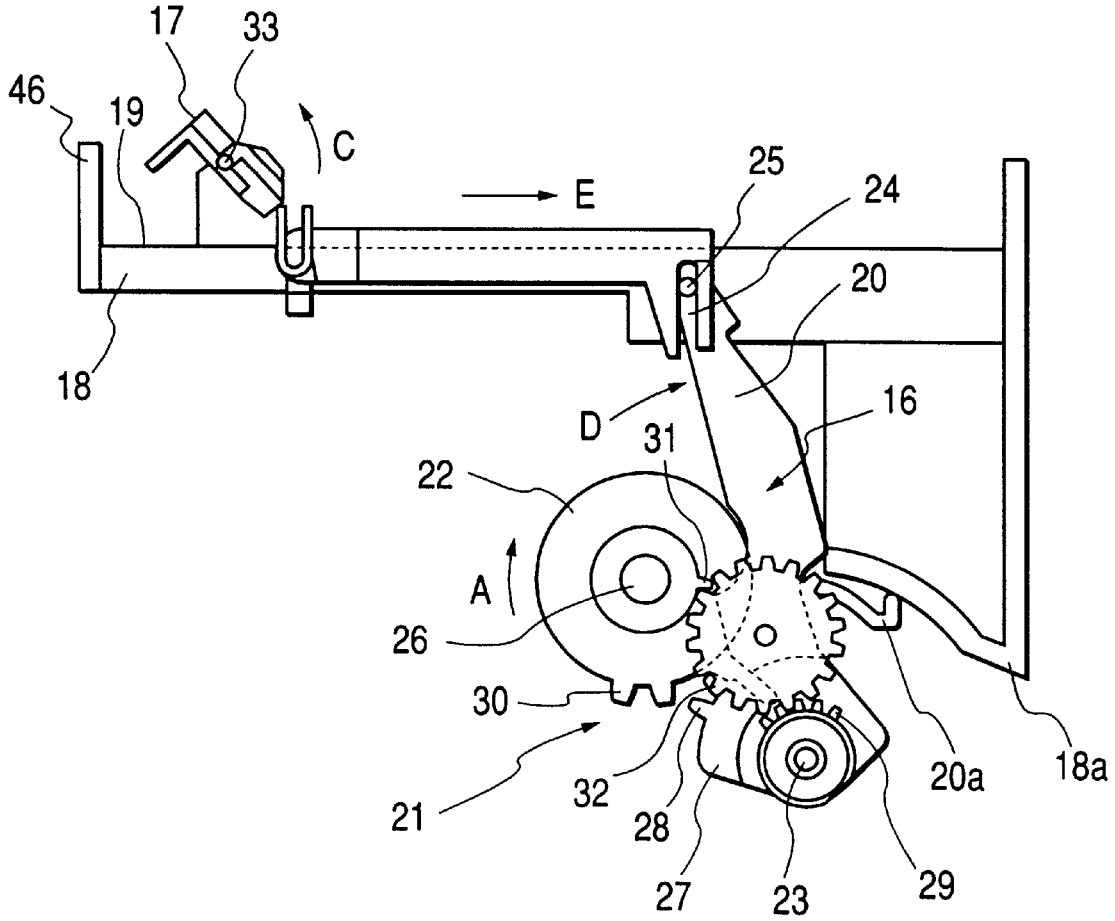
FIG. 7 is a side view which shows the state of the same operation of the blade cleaning operation as represented in FIG. 3, but it illustrates the state when the blade holder returns.

However, when the blade 14 has slipped under the blade cleaner 17, the bent portion of the blade 14 is released to restore itself to the original shape. At that moment, ink still adhering to the blade as remainders is caused to spray or splatter in the left direction as shown in FIG. 6. Therefore, it is preferable to arrange the wall 46 for the blade cleaner 17 as close as possible to the left in FIG. 6 in order to receive such sprayed ink. Also, it is extremely effective to arrange the eaves type screen 43 extensively from the blade cleaner 17.

When the driving gear 22 further rotates, the gear member 30 of the driving gear 22 for use of forward movement disengages from the gear member 28 of the blade arm 20. Then, the gear member 31 of the driving gear 22 for use of backward movement engages with the gear member 29 of the blade arm 20 through the idle gear 32, hence the driving force being transmitted. As a result, the blade arm 20 rotates in the reverse direction and begins rotating in the direction indicated by arrow D. Then, the blade moves in the direction E. In this case, when the blade 14 slips under the blade cleaner 17, the blade cleaner 17 now escapes to the extent of the portion where the blade 14 overlaps with the blade cleaner 17, while rotating in the direction indicated by arrow C. Thus, the blade cleaner is retracted. The blade 14 passes by pushing back the blade cleaner 17. In this manner, therefore, the spraying of ink is considerably reduced. Here, the reason why the spraying of ink cannot be completely eliminated is that, to be precise, the blade 14 is slightly bent to the extent that the biasing force is exerted by the spring 40 on the blade cleaner 17.

If the driving gear 22 continuously rotates in the state as it is, the blade 14 returns to the state as shown in FIG. 3, thus completing one round of the wiping operation. At this juncture, the elastic arm 20*a* of the blade arm 20 is positioned on the root of the cam 18*a* of the base 18. Therefore, the gear member 30 of the driving gear 22 disengages from the gear member 28 of the blade arm 20 to make the transmission of the driving force disabled. As a result, the blade arm 20 does not move from the position shown in FIG. 3 unpreparedly even if it is free.

As described above, depending on the rotational direction of the driving motor, the blade 14 can reciprocate, hence making it possible to execute the cleaning of the surface of discharge openings 13 and of the blade 14 itself in one processing step. Also, with the coaxial arrangement of the driving gear 22 and members that drive the cap (a capping cam and some others), which are driven to rotate in synchronism, it may be possible to arrange the one processing step described above for opening and closing the cap. In other words, the configurations and postures of the cam and gear, which are arranged coaxially to rotate in synchronism, are defined appropriately, and at the same time, the phase thereof is arranged to be deviated appropriately within one rotation. If the opening and closing of the cap and the reciprocation of the blade are performed under such appropriate arrangements, each of the operations can be executed reliably without any mutual intervention.

Also, for an ink jet recording apparatus having plural numbers of blades 14 in the main scanning direction, a gap should be provided between the walls 46 and 46 as shown in FIG. 9, and the portion that extends lower than the bottom surface of the walls 46 is also arranged each on the left and right ends, respectively. With the structure thus arranged, ink adhering to each wall 46 drops from the left and right ends naturally, thus making it possible to prevent ink from being mixed between blades 14.

Figure 12A:
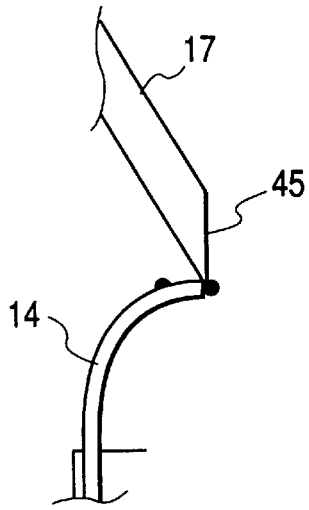
FIGS. 12A and 12B are cross-sectional views which illustrate the state of the moment the blade slips under the blade cleaner.
Figure 12B:
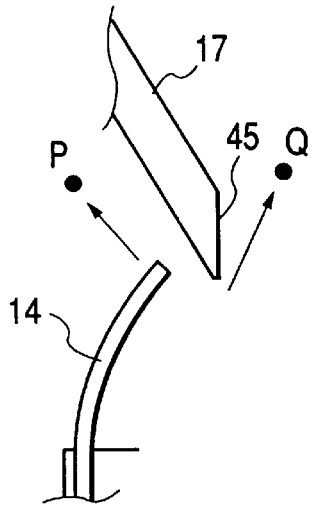
Figure 13A:
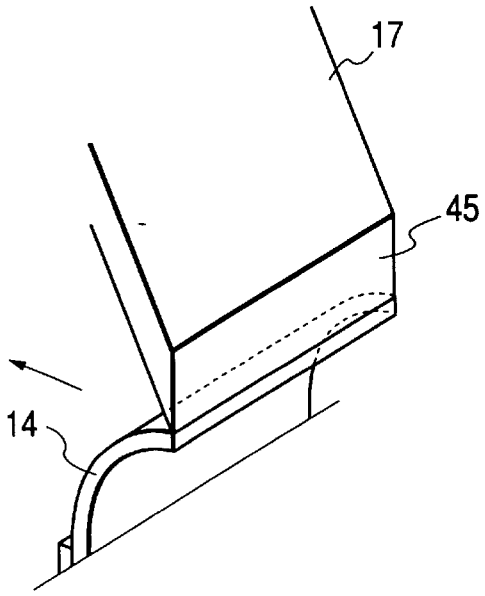
FIGS. 13A and 13B are perspective views which illustrate the example of the cleaning portion of the blade cleaning device.

Now, the description will be made further in detail of the state where the blade 14 slips under the cleaning portion 45 of the blade cleaner 17 in accordance with the present embodiment. FIGS. 12A and 12B are cross-sectional views which schematically shows the manner in which ink flies when the blade 14 slips under the blade cleaner 17. As shown in FIGS. 12A, 12B and 13A, the cleaning portion 45 of the blade cleaner 17 is cut at an acute angle, and extends substantially at right angles (substantially perpendicular to the surface of FIGS. 12A and 12B) to the direction in which the blade 14 moves. The blade 14 advances from the right to the left in FIGS. 12A and 12B. Here, FIG. 12A shows the state immediately before the blade 14 is about to slip under the blade cleaner 17. FIG. 12B shows the state immediately after the blade 14 has slipped under the blade cleaner 17.

Now, immediately after the blade 14 has slipped under the blade cleaner 17, the leading end of the blade 14 moves abruptly to the left in FIG. 12B, because the blade 14 that has been bent up to that moment by the presence of the blade cleaner 17 is released to restore itself to its original straight posture. This movement of the leading end of the blade 14 is much faster than the speed at which the blade holder 15 moves. Therefore, even if the moving speed of the blade 14 is slowed down, there is not much difference in this situation. For that matter, irrespective of the speeds at which the blade 14 moves, the ink droplets remaining on the blade 14 are caused to spread in the direction P. In order to prevent such spreading of ink from being dispersed in the interior of the ink jet apparatus, there are provided the walls 46 and the eaves type screen 43 for this particular purpose.

FIGS. 12A and 12B represent the forward operation of the blade 14. When the blade 14 returns to the original position, that is, when its operation is backward, the blade moves reversely to the right in FIGS. 12A and 12B. In this direction, the walls and the eaves type screen cannot be arranged because the carriage is present in that direction. Therefore, as described above, it is effective to arrange the structure so that the blade cleaner 17 can rotate and escape.

In this respect, there is a possibility that ink spreads in the direction Q in FIG. 12B, that is, behind the advancing direction of the blade 14, on the moment that the blade 14 has slipped under the cleaning portion 45 of the blade cleaner 17 in some cases. Further, of the ink which is about to spread in the direction P, ink that resides on the upper butt end of the blade 14 is caused to rebound when its flying course is blocked by the walls 46.

Figure 13B:
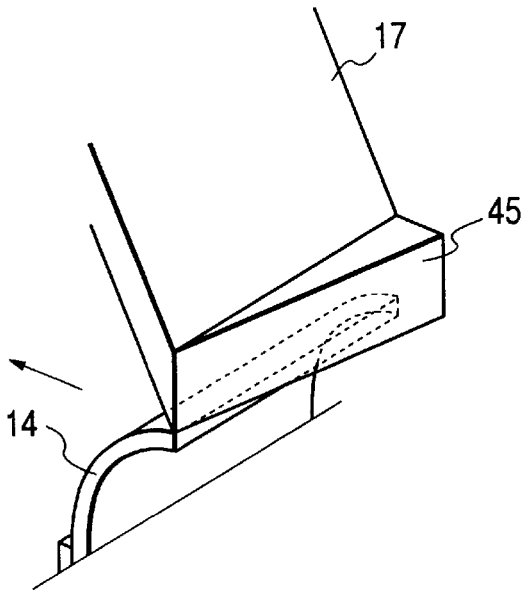

Therefore, in order to prevent such spreading of ink from being dispersed, it may be possible to adopt the structure given below with respect to the configuration of the cleaning portion 45 in accordance with the present embodiment. In other words, the cleaning portion 45 is structured so that it is inclined to the direction in which the blade 14 moves. FIGS. 13A and 13B are perspective views which schematically show the state immediately before the blade 14 is about to slip under the blade cleaner 17. When the cleaning portion 45 is configured as described above, the upper butt end of the blade 14 is seen immediately before the blade 14 is about to slip under the blade cleaner 17 as shown in FIG. 13A. Here, the entire leading end of the blade 14 passes the cleaning portion 45 almost at the same time.

Now that the blade cleaner 17 shown in FIG. 13B is such that its cleaning portion 45 is inclined to the direction in which the blade 14 moves, the portion of the blade that is observable is only the left side end thereof in FIG. 13B. Therefore, even if the blade 14 moves to gain the straight posture abruptly immediately after it has slipped under the cleaning portion, most of the part of the blade 14 is positioned behind the cleaning portion 45. As a result, the spreading of ink in the direction Q, that is, behind the advancing direction of the blade, is reduced significantly. In other words, the leading end of the blade 14 is allowed to part gradually beginning with one end, that is, the left end in FIG. 13B. Therefore, the leading end of the blade 14 does not part from the cleaning portion as if flicked at once. The leading end is allowed to part from it gradually beginning with one end, thus making it possible to prevent ink from being spread and dispersed.

Now, returning to FIG. 7, the description will be continuously made of the driving of the blade 14. When the driving gear 22 rotates, the gear member 30 of the driving gear 22 for use of forward movement disengages from the gear member 28 of the blade arm 20. Then, the gear member 31 of the driving gear 22 for use of backward movement engages with the gear member 29 of the blade arm 20 through the idle gear 32, hence the driving force being transmitted. As a result, the blade arm 20 rotates in the reverse direction and begins rotating in the direction indicated by arrow D. Then, the blade moves in the direction E. In this case, when the blade 14 slips under the blade cleaner 17, the blade cleaner 17 now escapes to the extent of the portion where the blade 14 overlaps with the blade cleaner 17, while rotating in the direction indicated by arrow C, and the blade cleaner is retracted. The blade 14 passes by pushing back the blade cleaner 17. In this manner, therefore, the spreading of ink is considerably reduced. Here, the reason why the spreading of ink cannot be completely eliminated is that, to be precise, the blade 14 is slightly bent to the extent that the biasing force is exerted by the spring 40 on the blade cleaner 17. Now, therefore, it is desirable to arrange the biasing force of the spring 40 to be as weak as possible but just to be good enough so that the blade cleaner 17 abuts upon the abutting portion 37 reliably.

If the driving gear 22 continuously rotates in the state as it is, the blade 14 returns to the state as shown in FIG. 3, thus completing one round of the wiping operation. At this juncture, the elastic arm 20*a* of the blade arm 20 is positioned on the root of the cam 18*a* of the base 18. Therefore, the gear member 30 of the driving gear 22 disengages from the gear member 28 of the blade arm 20 to make the transmission of the driving force disabled. As a result, the blade arm 20 does not move from the position shown in FIG. 3 unpreparedly even if it is free.

As described above, depending on the rotational direction of the driving motor, the blade 14 can reciprocate, hence making it possible to execute the cleaning of the surface of discharge openings 13 and the blade 14 itself in one processing step. Here, also, a driving force applied to the movement of the blade 14 may be arranged by a method that uses an actuator for enabling the driving motor to rotate regularly or reversely, or for enabling a solenoid or the like to operate a parallel movement.

Figure 10:
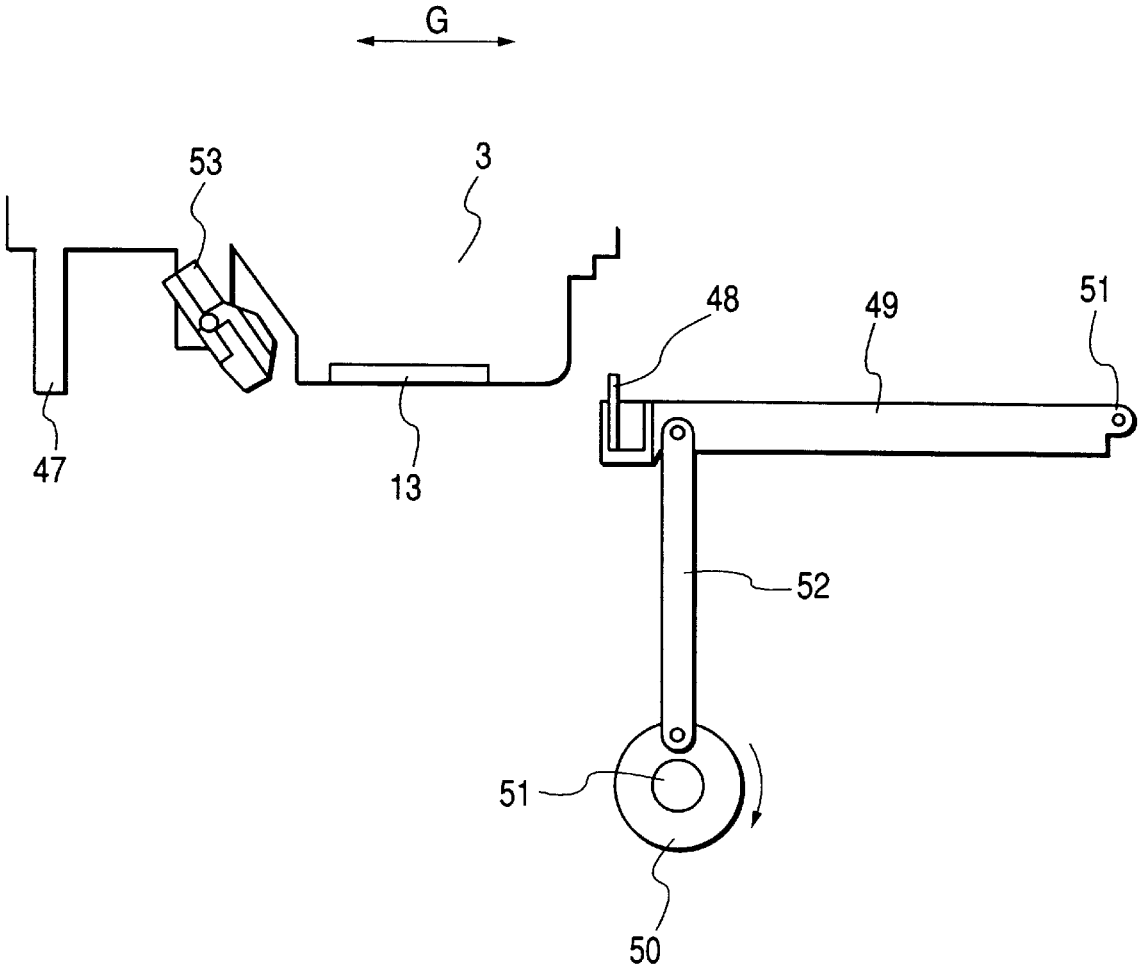
FIG. 10 is a side view which shows another example of the blade cleaning device of the present invention in the same manner as shown in FIG. 3.
Figure 11:
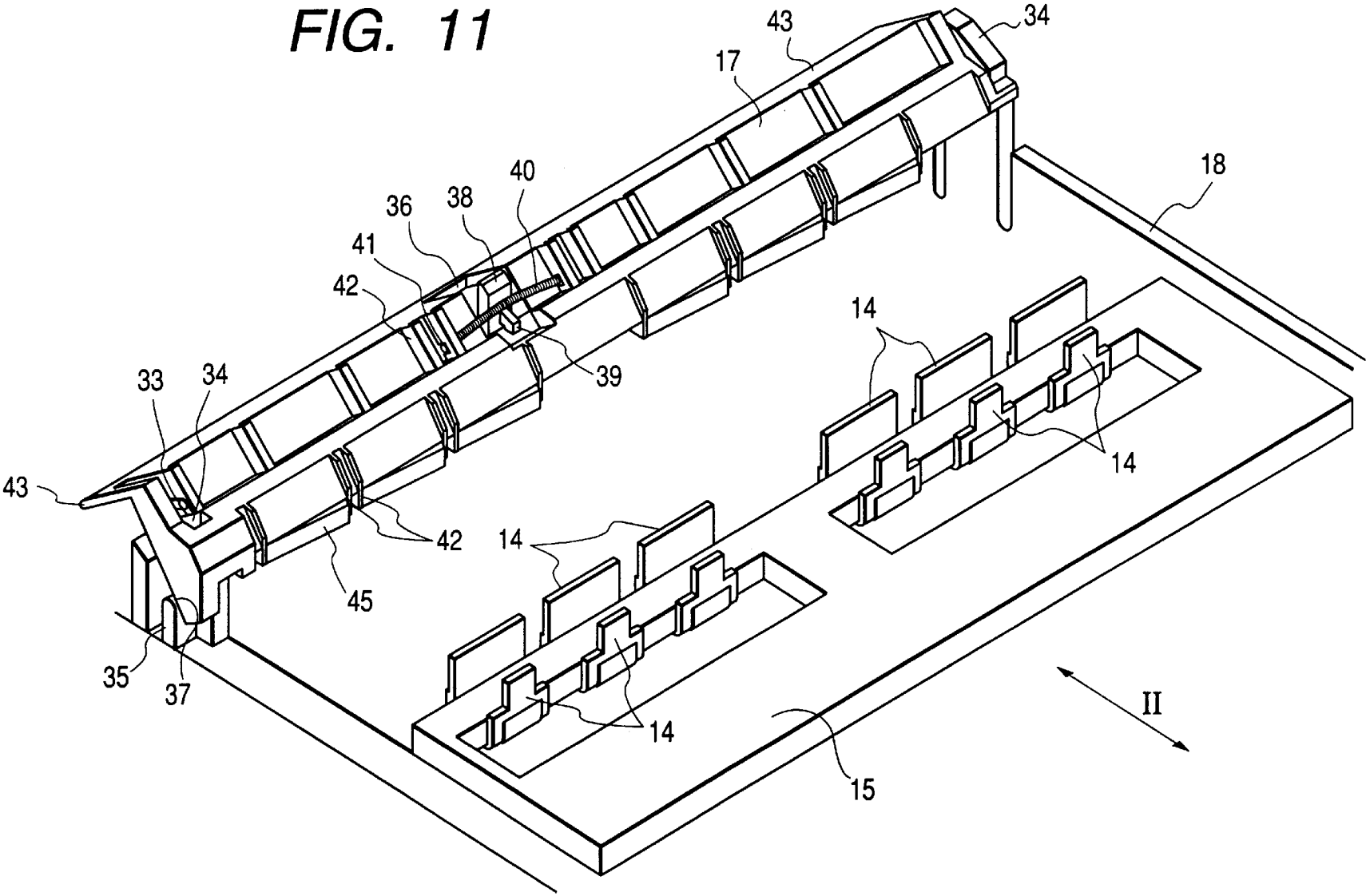
FIG. 11 is a view which shows another example of the blade cleaning device of an ink jet recording apparatus of the present invention in the same manner as shown in FIG. 2.

Also, with respect to an ink jet recording apparatus having plural numbers of blades 14 in the main scanning direction, if the cleaning portion 45 of the blade cleaner 17 is formed by the molding formation or the like, a gap should be provided between the adjacent cleaning portions 45 and 45 as shown in FIG. 9, and the portion that extends lower than the bottom surface of the cleaning portion 45 is also arranged each on the left and right ends, respectively. With the structure thus arranged, ink adhering to the cleaning portion 45 drops from the left and right ends naturally, thus making it possible to prevent ink mixed between the cleaning portions 45 from being caused to adhere to the blade 14 again and mixed on the blade 14. cl Second Embodiment Now, with reference to the accompanying drawings, the description will be made of the cleaning device of an ink jet recording apparatus in accordance with a second embodiment of the present invention. FIG. 10 is a side view schematically showing the circumferential structure of the cleaning device in accordance with the present embodiment. Here, the wiping operation is executed by means of the main scanning of a carriage.

As shown in FIG. 10, the main scanning direction is indicated by arrows G for the ink jet recording head 3 of the ink jet recording apparatus. On the front of the surface of discharge openings 13, a wall 47 is provided for the prevention of ink spraying. The blade 48 is installed on the blade holder 49 to wipe the surface of discharge opening 13 of this ink jet recording head 3. The blade holder is axially supported on the base shaft 45 (not shown). Therefore, when the blade holder 49 is allowed to swing, the blade 48 ascends or descends to make selection possible for the intended wiping operation. The circular disc 50 that drives the blade holder 49 in the vertical direction is rotatively supported by the shaft 51. One end of link 52 is connected with the blade holder 49. The other end is connected with the circular disc 50. As a result, the circular disc 50 rotates around the shaft 51, thus moving the blade 48 on the blade holder 49 in the vertical direction through the link 52.

In accordance with the present embodiment, the blade cleaner 53 of the cleaning device is rotatively installed on the ink jet recording head 3 or on the carriage 2 that mounts the ink jet recording head 3 as in the case of the first embodiment.

Therefore, with the structure thus arranged, it is possible to reduce the ink spreading into the interior of an ink jet recording apparatus suitably by means of the cleaning device that performs wiping in the main scanning direction of the carriage 2 of the ink jet recording apparatus 1.

What is claimed is:

1. An ink jet recording apparatus comprising:

a blade for wiping a surface of a discharge opening of an ink jet recording head;

a blade cleaner for removing ink adhering to said blade; and a moving mechanism for moving said blade and said blade cleaner correlatively, wherein said moving mechanism causes said blade to be in first elastic contact with said blade cleaner without rotating said blade cleaner when said blade and said blade cleaner move correlatively in one direction, and causes said blade to push said blade cleaner and thereby to rotate said blade cleaner so said blade is in second elastic contact with said blade cleaner when said blade and said blade cleaner move correlatively in another direction, the second elastic contact being weaker than the first elastic contact.

2. An ink jet recording apparatus according to claim 1, wherein a portion of said blade cleaner to be in contact with said blade is formed by a member for absorbing ink.

3. An ink jet recording apparatus according to claim 1, wherein said blade cleaner and blade are inclined to a direction of the correlative reciprocation thereof.

4. An ink jet recording apparatus according to claim 3, wherein said blade cleaner is inclined to the direction of the movement of said blade.

5. An ink jet recording apparatus according to claim 4, wherein said blade cleaner is in the shape of a wedge.

6. An ink jet recording apparatus according to claim 1, wherein a portion of said blade cleaner to contact with said blade comprises a molded edge.

7. An ink jet recording apparatus according to claim 1, wherein a portion of said blade cleaner to contact with said blade comprise a metallic edge.

8. An ink jet recording apparatus according to claim 6 or 7, wherein portions of said edge arranged at both ends of said edge extend lower than other portions of said edge.

9. An ink jet recording apparatus according to claim 1, wherein a bend of a closely coiled spring in a diameter direction thereof is used for biasing said blade cleaner.

10. An ink jet recording apparatus according to claim 1, wherein a tensioning coil spring is used for biasing said blade cleaner.

11. An ink jet recording apparatus according to claim 1, wherein a twisted coil spring is used for biasing said blade cleaner.

12. An ink jet recording apparatus according to claim 1, wherein walls are arranged on said blade cleaner on a side of said blade cleaner opposite to the ink jet recording head.

13. An ink jet recording apparatus according to claim 1, wherein said ink jet recording head comprises means for generating bubbles in ink by utilizing thermal energy, and discharging the ink by application of said bubbles.

14. A method for recovering an ink jet recording head comprising the steps of:

wiping a surface of a discharge opening of the ink jet recording head by use of a blade;

cleaning said blade by causing said blade to contact with a blade cleaner; and rotating said blade cleaner by pushing said blade cleaner with said blade when said blade returns to an original position before said wiping step through a same path in said cleaning step.

* * * * *

UNITED STATES PATENT AND TRADEMARK OFFICE

CERTIFICATE OF CORRECTION

PATENT NO. : 5,984,452

DATED : November 16, 1999

INVENTOR(S) : TOSHIHIKO BEKKI

It is certified that error appears in the above-identified patent and that said Letters Patent is hereby corrected as shown below:

[57] ABSTRACT:
Line 9, "for" should be deleted.

COLUMN 2:
Line 8, "besides" should read --beside--.
Line 57, "scape" should read --scrape--.

COLUMN 4:
Line 2, "condition" should read --condition.--.

COLUMN 12:
Line 9, "shows" should read --show--.

COLUMN 15:
Line 8, "comprise" should read --comprises--.

Signed and Sealed this

Twenty-fourth Day of October, 2000

*Attest:*

Q. TODD DICKINSON

*Attesting Officer*

*Director of Patents and Trademarks*